US005116064A

United States Patent [19]

Corlett

[11] Patent Number: 5,116,064

[45] Date of Patent: May 26, 1992

[54] GAME POST ASSEMBLY

[76] Inventor: Joshua Corlett, 71 Loveland Hill Rd., Vernon, Conn. 06066

[21] Appl. No.: 564,784

[22] Filed: Aug. 9, 1990

[51] Int. Cl.[5] ..... F41J 5/18

[52] U.S. Cl. ..... 273/390; 273/181 J; 273/411; 52/116; 404/10

[58] Field of Search ..... 116/173; 52/116, 298; 404/10; 273/181 R, 41, 127 D, 181 J, 181 K, 177 A, 390, 411, 391

[56] References Cited

U.S. PATENT DOCUMENTS

| | | | |
|---|---|---|---|
| 2,095,016 | 10/1937 | Waterbor | 404/11 |
| 2,360,248 | 10/1944 | Mace | 52/116 |
| 3,081,114 | 3/1963 | Esty | 52/116 |
| 3,599,599 | 8/1971 | Jones | 116/173 |
| 3,635,476 | 1/1972 | Breslow | 273/127 D |
| 4,106,879 | 8/1978 | Diedershagen | 404/10 |
| 4,364,688 | 12/1982 | Bitvani | 404/10 |
| 4,819,937 | 4/1989 | Gordon | 273/26 |

*Primary Examiner*—John E. Murtagh
*Attorney, Agent, or Firm*—Ira S. Dorman

[57] ABSTRACT

A target assembly utilizes a post that is so supported on a base as to enable it to maintain positions deflected from its normally upright orientation.

8 Claims, 3 Drawing Sheets

GAME POST ASSEMBLY

BACKGROUND OF THE INVENTION

Ground-supported targets are often employed in connection with sports games, and may be used for practice to develop necessary skills. In games such as soccer, the accuracy and strength of delivery of a kicked ball are of course of prime importance. While it is self-evident that mere impact upon a target can be readily determined, the effectiveness of the kick (i.e., the accuracy and force with which the ball hits the target) is not so apparent, and simply noting that contact has been made provides no basis for evaluating it.

Accordingly, it is the broad object of the present invention to provide a novel target assembly that is adapted for ground support and is capable of indicating the effectiveness of impact thereupon by a ball or the like.

A more specific object is to provide such an assembly which is capable of either outdoor or indoor emplacement.

Additional objects are to provide a target game assembly having the foregoing features and advantages, which is relatively facile and inexpensive to manufacture, is convenient to set up for use, and is highly effective for its intended purposes.

SUMMARY OF THE INVENTION

The foregoing and related objects of the invention are attained by the provision of a target assembly that includes a ground-engaging base member having an upper portion that lies generally in a horizontal plane in the position of normal use, and a target member mounted upon the base member in a normally upstanding orientation. The means by which the target member is mounted operatively engages its lower portion and permits substantially universal deflection in vertical planes about the base member. The assembly also includes means for automatically maintaining any position of the target member deflected from its upstanding orientation, thus indicating the effectiveness of impact thereupon.

The target member will normally take the form of a post. The base member will advantageously have an upwardly opening socket, with the mounting means comprising a ball that is rotatably and pivotably seated in the socket and is operatively attached to the lower portion of the target member. The "means for maintaining" may comprise an element that bears against the ball and serves to frictionally retard or inhibit its free movement.

Either a peg that is adapted to be driven into the ground, or of a free-standing body that is of sufficient mass to support the target member, may comprise the base member. Such a peg may have an upper end portion that engages the base in an adjustable manner, and that bears directly upon the ball in the socket to thereby provide the retarding element. The bearing element in a free-standing base may comprise a plug that is disposed to communicate with the socket, and is of adjustable position relative thereto.

DETAILED DESCRIPTION OF THE ILLUSTRATED EMBODIMENTS

Figure 1:
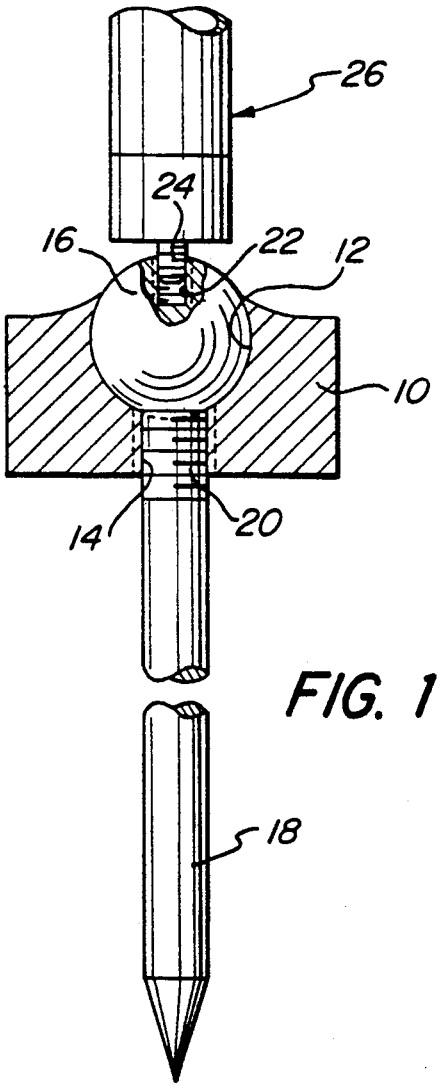
FIG. 1 is a fragmentary elevational view, in partial section, showing a target assembly embodying the present invention.
Figure 2:
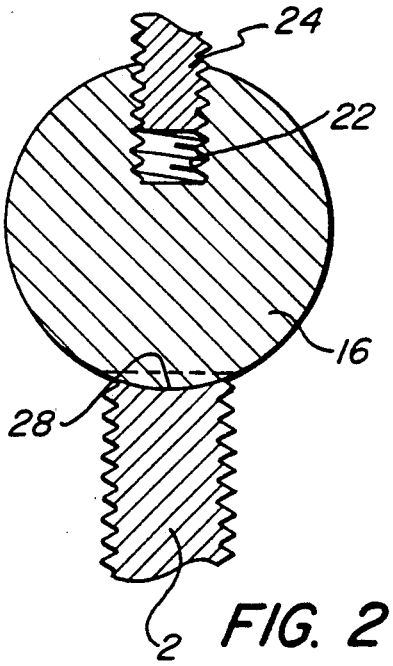
FIG. 2 is a fragmentary sectional view showing components of the assembly of FIG. 1 and drawn to a scale enlarged therefrom.

Turning now in detail to FIGS. 1–4 of the appended drawings, therein illustrated is a target assembly embodying the present invention and including a block 10 having a spherical socket 12 formed into its upper portion, and a threaded passage 14 extending upwardly into the socket 12. A ball 16 is pivotably and rotatably seated in the socket 12, for substantially universal movement, and a pointed peg 18 has its threaded upper end portion 20 engaged within the passage 14. A threaded bore 22 extends radially into the ball 16, and engages one end of the threaded stud 24 of a post subassembly, generally designated by the numeral 26. As will be noted, the upper end of the peg 18 is formed with a spherical recess 28, which engages the surface of the ball 16. The peg 18 thus serves to apply frictional resistance to rotation of the ball in the socket 12, the level of which can be controlled merely by adjusting the depth of penetration of the peg 18.

Figure 4:
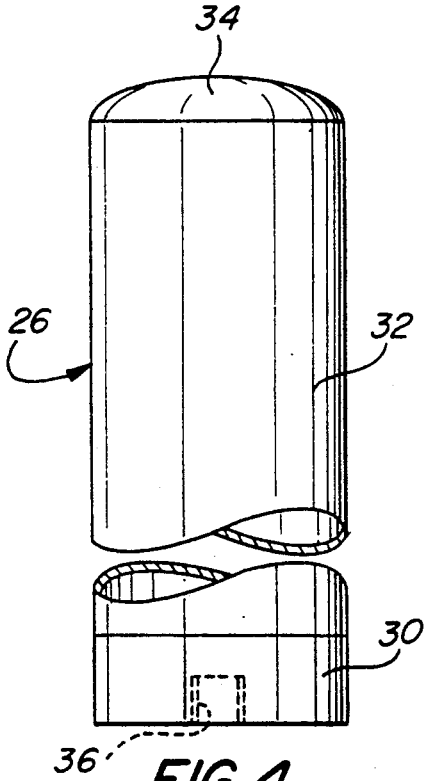
FIG. 4 is an elevational view of the post utilized in the assembly of FIG. 1, drawn to an enlarged scale.

Post 26 is shown in greater detail in FIG. 4, and consists of a solid base portion 30, a hollow body portion 32, and a cap portion 34, all of cylindrical cross section. A threaded bore 36 extends inwardly from the bottom surface of the base portion 30, in which bore is engaged the opposite end of the threaded stud 24.

Figure 5:
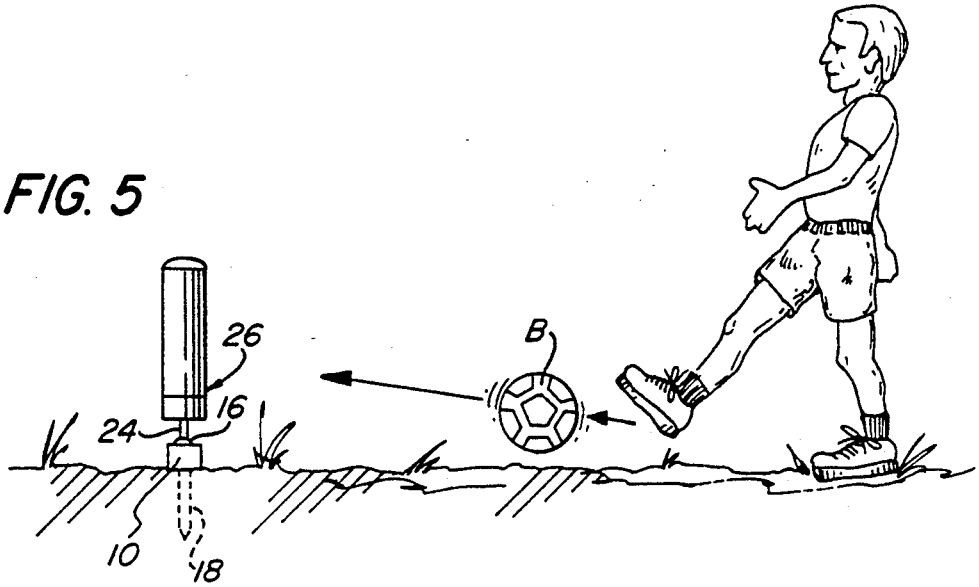
FIG. 5 is a diagrammatic representation showing the assembly of the invention in use.
Figure 6:
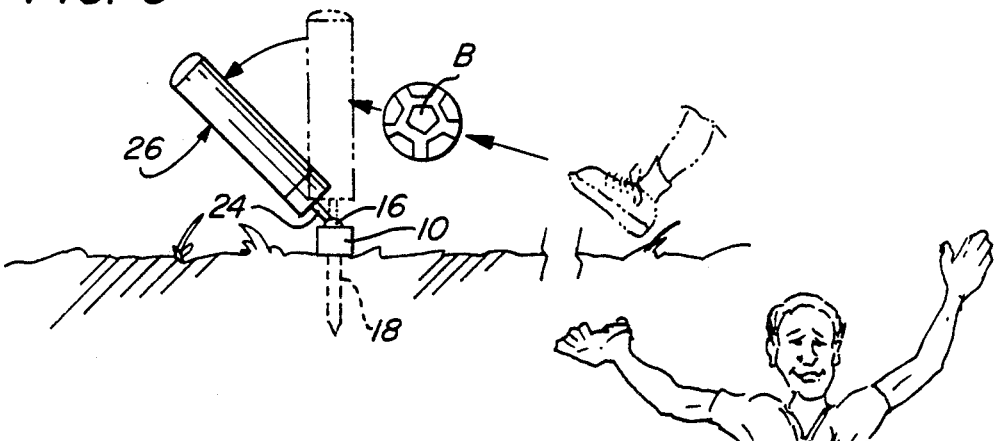
FIG. 6 is a view similar to FIG. 5, with the post member of the target assembly deflected as a result of contact by a ball.
Figure 7:
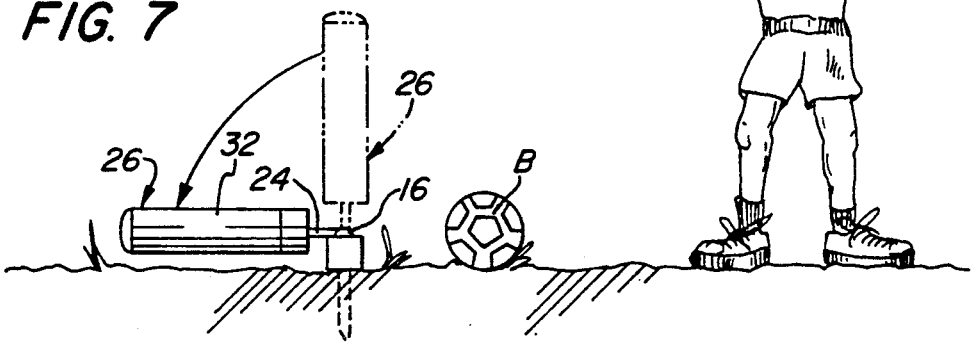
FIG. 7 is a view similar to FIGS. 5 and 6, showing the post member of the assembly in a fully downed position.

Use of the assembly of the invention is illustrated in FIGS. 5–7. To set up the assembly the peg 18 need only be forced into the ground to a depth sufficient to bring the body 10 to ground level. The post 26 will normally be in an upright orientation, to present to the soccer player shown a target for kicking practice.

As seen in FIG. 5 the player has kicked the ball B toward the target, and in FIG. 6 the ball has hit the post and deflected it. FIG. 7 indicates that the ball has been directed with sufficient accuracy, and speed or force, to knock the post 26 fully to the ground.

Had the ball B contacted the post 26 with a glancing blow, or had the force on the ball had been inadequate, the post 26 might only have attained the deflected position of FIG. 6. It would have remained in that position so as to thereby provide a direct visual indicator of the effectiveness (i.e., force and accuracy) of the impact produced by the player's kick.

Figure 9:
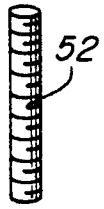
FIG. 9 is a perspective view of a threaded shaft adapted for use in association with the base subassembly of FIG. 8.
Figure 3:
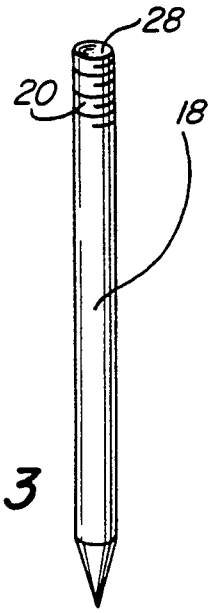
FIG.3 is a perspective view of a ground peg utilized in the assembly of the previous Figures, drawn to a reduced scale.
Figure 8:
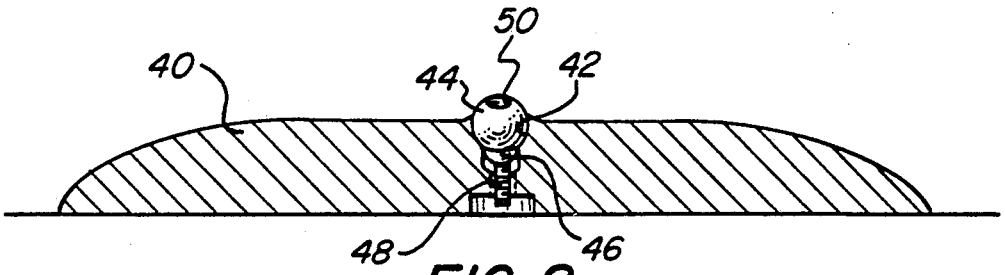
FIG. 8 is an elevational view, in partial section, of a base subassembly of which the target assembly of the invention may be comprised.

FIGS. 8 and 9 illustrate a modification of the assembly by which it is adapted for indoor use, or for emplacement on pavement or another hard outdoor surface. The modified assembly utilizes a heavy base 40, into the upper surface of which is formed a spherical socket 42 in which a ball 44 is seated for substantially universal movement, as previously described. A plug 46 is disposed at the bottom of the socket 42, and has an associated screw 48 which is engaged in a threaded opening (unnumbered) of the base 40 and is accessible from the underside thereof. Variation of the depth of the screw 48 will adjust the position of the plug 46 and thereby the level of frictional resistance that it exerts on the ball 44, in turn serving to inhibit free movement of the ball within the socket 42 to a desirable degree.

The ball 44 has a threaded bore 50 extending radially into it, in which one end of the threaded shaft 52 may be engaged. As will be appreciated, the opposite end of the shaft 52 will be engaged within the threaded recess 36 to attach the post 26. The manner of use of the assembly of FIGS. 8 and 9 is of course the same as was described previously with reference to FIGS. 5–7.

It will also be appreciated that many variations may be made in the assembly of the invention, and in the components of which it is comprises, without departure from the novel concepts of the present invention. Although the post 26 and other parts will desirably be made of plastic, and the base 40 will desirably be of metal construction (as to inherently afford to it the desired mass), any suitable materials may be utilized , as will be evident to those skilled in the art. Thus, a sand- or water-filled plastic base may be employed, and the post may be of metal or wooden construction, or of a combination of different material, if so desired. Needless to say, the configuration of the post may be varied to provide an optimal target, and it may of course be decorated in any suitable manner.

By way of example, and without limitation, it might be mentioned that the post (in the cylindrical form illustrated) would typically have a diameter of 4 inches and a length of 25 inches. The peg used for outdoor installation would advantageously be about 6 inches in length for normal ground engagement, but would be lengthened (to perhaps 10 inches) when the soil is soft or when the assembly is to be used in sand. The free-standing base may be about 28 inches in diameter, depending somewhat upon the weight of the material from which it is made, and the associated threaded shaft would typically be on the order of 4 inches long. The block assembled with the outdoor pegs may be approximately ½ inch to 2 inches in height (to place the pivot point of the target at an appropriate level); its horizontal cross-section is of less functional significance, but may be of similar dimensions.

The ball and socket constructions shown are regarded to be desirable from the standpoint of providing the required functions in an uncomplicated and inexpensive manner. Nevertheless, different arrangements for enabling the target member to maintain a partially deflected position, or to be felled completely by impact, may occur to those skilled in the art and may be substituted for that of the embodiment illustrated.

Thus, it can be seen that the present invention provides a novel target assembly that is adapted for ground support and is capable of indicating the effectiveness of impact by a ball or the like. The assembly can be adapted for emplacement either inside or out-of-doors, it is relatively facile and inexpensive to manufacture, it is convenient to set up for use, and it is highly effective for its intended purposes.

Having thus described the invention, what is claimed is:

1. A target assembly comprising: a ground-engaging base member with an upper portion lying generally in a horizontal plane, in the position of normal use of said assembly; a target member having a lower portion; means for mounting said target member on said base member in a normally upstanding orientation, said means for mounting operatively engaging said lower portion of said target member and permitting substantially free and universal deflection of said target member therewithin, under kicked-ball impact, in all vertical planes about said base member; and means for maintaining said target member in any position deflected from said upstanding orientation, whereby the effectiveness of ball impact upon said target member can be indicated by the position to which it has been deflected thereby.

2. The assembly of claim 1 wherein said target member is a post.

3. The assembly of claim 1 wherein said base member has an upwardly opening socket therein, and wherein said mounting means comprising a ball rotatably and pivotably seated in said socket, said ball being operatively attached to said lower portion of said target member.

4. The assembly of claim 3 wherein said means for maintaining comprises an element bearing against said ball to frictionally retard movement thereof.

5. The assembly of claim 1 wherein said base member comprises a peg adapted to be driven into the ground.

6. The assembly of claim 1 wherein said base member comprises a free-standing body of sufficient mass to support said target member, while permitting relative deflection thereof by such impact thereupon.

7. The assembly of claim 4 wherein said base member includes a peg adapted to be driven into the ground, and wherein said peg has an upper end portion adjustably engagable with said base member, said peg also providing, on the upper end thereof, said bearing element of said means for maintaining.

8. The assembly of claim 4 wherein said base member comprises a free-standing body of sufficient mass to support said target member while permitting relative deflection thereof by such impact thereupon, and wherein said means for maintaining includes a plug disposed within said base member in communication with said socket thereof, and means for adjustably positioning said plug relative to said socket, said plug having thereon said bearing element of said means for maintaining.

* * * * *